US005136477A

United States Patent [19]

Lemmey

[11] Patent Number: 5,136,477

[45] Date of Patent: Aug. 4, 1992

[54] MINIATURE BATTERY-POWERED LIGHTING DEVICE

[76] Inventor: Edgar S. Lemmey, 920 Blvd. of the Arts, Marina Suite, Sarasota, Fla. 34236

[21] Appl. No.: 784,151

[22] Filed: Oct. 28, 1991

[51] Int. Cl.[5] ..... F21L 1/00; F21L 7/00

[52] U.S. Cl. ..... 362/198; 362/157; 362/419; 362/109

[58] Field of Search ..... 362/23, 157, 190, 157, 362/198, 200, 285, 413, 414, 418, 419, 109, 85

[56] References Cited

U.S. PATENT DOCUMENTS

| | | | |
|---|---|---|---|
| 1,692,394 | 11/1928 | Sundh | 362/198 |
| 2,648,762 | 8/1953 | Dunkelberger | 362/198 |
| 3,103,723 | 9/1963 | Becker | 362/198 |
| 3,393,312 | 7/1968 | Dahl | 362/198 |
| 3,681,590 | 8/1972 | Dickie | 362/198 |
| 3,737,722 | 6/1973 | Scharlace | 362/198 |
| 4,949,230 | 8/1990 | Burmeister | 362/109 |

*Primary Examiner*—Richard R. Cole
*Attorney, Agent, or Firm*—Charles J. Prescott

[57] ABSTRACT

A miniature self-powered portable illuminating device including a thin-wall molded rectangular housing and removable bottom cover defining a battery compartment. The top surface of the housing includes a momentary on/off switch and an elongated flexible conduit mounted thereon. the conduit is economically formed using only protective coated dual-conductor stranded flexible wire tightly covered with a thin-wall plastic tube over its entire exposed length. By this arrangement, the molded reflector and sub-miniature high-intensity light bulb mounted therein may be easily manipulated into any desired shape. The housing is releasably attachable onto a working surface adjacent to or part of an object to be illuminated.

4 Claims, 1 Drawing Sheet

MINIATURE BATTERY-POWERED LIGHTING DEVICE

BACKGROUND OF THE INVENTION

This invention relates generally to illumination devices, and more particularly to a miniature hand transportable illumination device attachable to objects for momentary on/off use.

There are many instances in which a small but focused light source is useful for illuminating a small area. Many television watchers, for example, find it difficult to manipulate a remote controller when viewing the television in a dark room. Locating a room thermostat at night may be straightforward; however, seeing the dial for adjustment is considerably more difficult without the benefit of a light source.

Nighttime aircraft and marine navigation generally requires a red light available for reading charts and other paperwork so that the eyes are not forced to reverse-dilate from a white light source, temporarily loosing night vision.

There are many other instances when a small portable light is required or very useful to be either temporarily or permanently attached to such objects for illumination.

Additionally, such a light source would ideally be one of momentary on/off characteristic so that the self-contained battery source would not be unnecessarily drained.

Applicant is aware of a number of devices which are specifically adapted for either attachment or inclusion in a remote control unit for television as follows:

| | |
|---|---|
| Kaminski | 4,905,127 |
| Burmeister | 4,949,230 |
| Mintzer | 5,010,426 |

The present invention provides such a miniature light source which is sized to be easily attached to, or adjacent a wide variety of objects for illumination and includes an economically manufactured flexible conduit for supporting the reflector which houses the light bulb. By this arrangement, the device may be easily attached by adhesive, VELCRO (hook and loop type position etc) or magnet and then manipulated to adjust a directed light source against the object for illumination.

BRIEF SUMMARY OF THE INVENTION

This invention is directed to a miniature self-powered portable illuminating device including a thin-wall molded rectangular housing and removable bottom cover defining a battery compartment. The top surface of the housing includes a momentary on/off switch and an elongated flexible conduit mounted thereon. The conduit is economically formed using only protective coated dual-conductor stranded flexible wire tightly covered with a thin-wall plastic tube over its entire exposed length. By this arrangement, the molded reflector and sub-miniature high-intensity light bulb mounted therein may be easily manipulated into any desired shape. The housing is releasably attachable onto a working surface adjacent to or part of an object to be illuminated.

It is therefore an object of this invention to provide a miniature self-powered, portable, hand carryable illumination device which may be readily attached to or adjacent an object for illumination and which includes an easily manipulable conduit which supports the light bulb and reflector therearound for easy light direction adjustment over a wide range.

It is yet another object of this invention to provide a miniature illumination device having an easily adjustable reflector and light source and wherein the light source red colored for night-time navigation use.

It is yet another object of this invention to provide a miniature light source of a universal nature having a momentary on/off switch for conserving battery cell energy.

It is yet another object of this invention to provide a miniature self-contained portable illumination device which is easily attachable to articles for illumination such as remote control devices and wall-mounted household room thermostats.

In accordance with these and other objects which will become apparent hereinafter, the instant invention will now be described with reference to the accompanying drawings

DETAILED DESCRIPTION OF THE INVENTION

Figure 1:
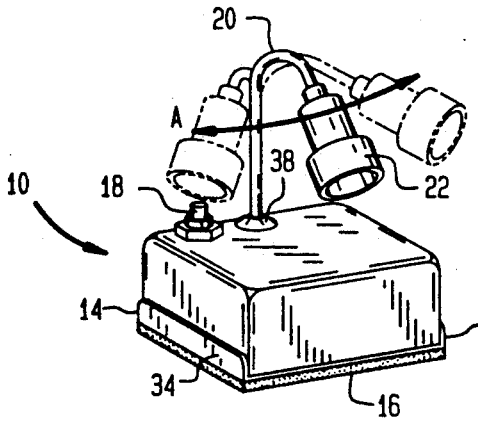
FIG. 1 is a perspective view of the invention.

Referring now to the drawings, the invention is shown generally at numeral 10 and includes a stamp or press formed thin-wall metal housing 12 having a top surface and side walls and generally having a rectangular shape wherein the width and depth are of similar proportions. The upright side walls are generally substantially smaller than the width and depth and generally equal to the diameter of a conventional miniature battery cell 26 as shown in FIG. 3.

Figure 3:
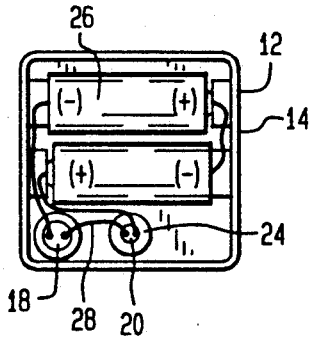
FIG. 3 is a bottom plan view of FIG. 1 showing the bottom cover removed.

A thin metal bottom cover 14 is also provided for enclosing the battery compartment formed by housing 12 as best seen in FIG. 3. This bottom cover 14 includes upstanding opposing flanges 34 and 36 which are inwardly biased so as to press against the corresponding side walls of housing 12 to retain the bottom cover 14 in place and yet render it easily removable for servicing and replacing the battery cells 26 contained within housing 12.

Mounted in the top surface of housing 12 is a momentary on/off switch 18 and a flexible conduit 20. Conduit 20 is secured to housing 12 and additionally supported by flanges 24 and 38. The momentary on/off switch 18 is operably connected as seen in FIG. 3 between the battery cells 26 and a pair of conductor wires 28 which extend through the length of the interior of conduit 20.

Figure 4:
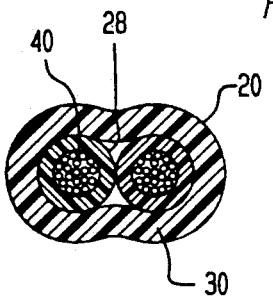
FIG. 4 is a section view in the direction of arrows 4—4 in FIG. 2.
Figure 5:
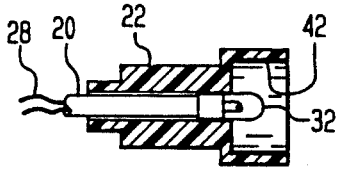
FIG. 5 is a section view in the direction of arrows 5—5 in FIG. 2.

As best seen in FIGS. 4 and 5, conduit 20 is constructed having a the two wires 28 formed of copper strands 40 each surrounded by a protective plastic layer.

Surrounding both protectively coated wires 28 is an additional tubuler plastic shield 30 which is made tightly conforming therearound as best seen in FIG. 4. This outer tubular shield 30 may be formed of very thin-walled heat shrinkable plastic so as to insure tight conformity around the plastic coated wires 28.

As best seen in FIG. 5, a molded plastic reflector 22 is provided connected to the distal end of conduit 20 which houses a subminiature white bulb 32 operably connected to wires 28. The interior 42 of reflector 44 is preferably of a cylindrical shape and having a white coating applied thereto.

Referring back to FIG. 2, then it should be now understood that conduit 20 is rendered extremely flexible in nature allowing the reflector 22 to be positioned in virtually any direction such as in the direction of arrows A & B and may be positioned closer or further from housing 12 as desired. Because of the construction previously described with respect to FIG. 4, the elements of conduit 20 render it virtually infinitely manipulatable and yet sufficiently rigid so as to maintain the position obtained by manual manipulation without jiggle or vibration of the reflector 22.

Connected to the lower surface of bottom cover 14 is a magnetic sheet 16 which renders the device 10 easily attachable to any metallic surface. However, it should be understood that the magnetic sheet 16 may be replaced by either a two part mating hook and loop arrangement or an adhesive sheet having a protective cover for only a single or a relatively few number of installations of the device 10 onto a working surface.

It should be now understood that the size and shape of the device 10 renders same easily attachable to small objects such as a remote controller for a television, VCR or stereo, and likewise renders the device 10 attachable against a surface of a room thermostat or the wall surface adjacent thereto.

In order to adapt the invention for nighttime navigation, the white high intensity bulb 32 may be replaced by a red high intensity light emitting diode preferably having a prefocused lens so as to direct and focus a red light onto, for example, a chart. Because the of the smallness of the size and shape of the device 10, it may be readily attached to a bulkhead, an instrument panel cluster or the like which are typically found in aircraft and marine vessels.

Figure 2:
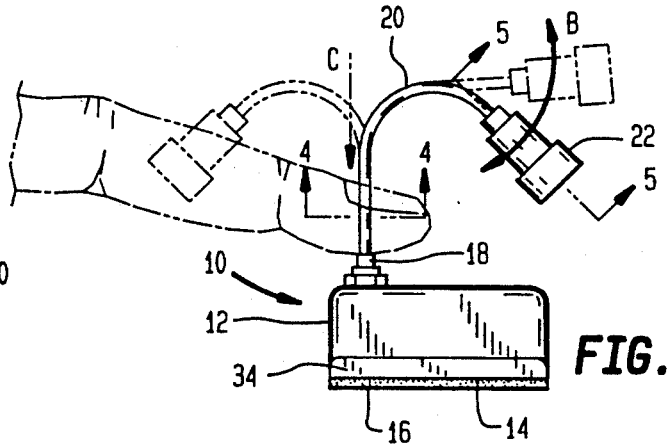
FIG. 2 is a side elevation view of FIG. 1.

As shown in FIG. 2 in phantom, the momentary on/off switch 18 is held in the "on" position by fingertip pressure in the direction of arrow C, the light source deenergized when switch 18 is released.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A miniature self-powered, portable illuminating device sized to be transported in the palm of a hand, said illuminating device comprising:

a thin wall molded housing having a top and upright side walls defining an open bottom;

a removable bottom cover releasably connected to and closely mating around said side walls and covering said open bottom and defining, in cooperation with said housing, a battery compartment for removably retaining a battery;

a momentary on/off switch mounted through said top, a spring-biased control button of said switch upwardly extending from said top for momentary finger actuation;

a flexible elongated conduit connected at one end to said top adjacent said switch and including a molded miniature light reflector connected at an opposite end thereof;

a high-intensity subminiature light source operably connected within said light reflector to one end of a dual-conductor stranded flexible plastic-shielded length of wire, an opposite end of said wire operably connected to said switch and said battery whereby said light source is energized only when said control button is depressed to overcome said spring bias;

said wire forming an interior of said conduit, said conduit also including an exterior thin-wall tubular layer of flexible plastic closely conforming around said wire;

said wire and outer tubular layer cooperatively structured to allow pliable manual manipulation of said conduit to any desired shape, which shape will be maintained only by said wire and outer tubular layer whereby said reflector and light source are aimed as required;

said bottom cover including downwardly facing means for releasably attaching said housing onto or adjacent a flat surface of an object to be momentarily illuminated.

2. A miniature self-powered, portable illuminating device as set forth in claim 1, wherein:

said housing is generally rectangular having a width and length similar one to another and wherein said housing and bottom cover are formed of very thin contoured metal;

said bottom cover includes opposing upwardly extending flanges which biasingly press against two opposing said side walls to retain said bottom cover in place over said open bottom.

3. A miniature self-powered, portable illuminating device as set forth in claim 1, wherein:

aid reflector includes a white-colored cylindrical circular cavity around said light source.

4. A miniature self-powered, portable illuminating device as set forth in claim 1, wherein:

said light source is a red-colored light-emitting diode having a prefocused lens;

said illuminating device being particularly adapted for illumination during nighttime navigation.

* * * * *